US006578815B2

(12) United States Patent
Sanger

(10) Patent No.: US 6,578,815 B2
(45) Date of Patent: Jun. 17, 2003

(54) CONCRETE WALL AND RIB FORM

(76) Inventor: Wallace D. Sanger, 11333 Acme Rd., West Palm Beach, FL (US) 33414

( * ) Notice: Subject to any disclaimer, the term of this patent is extended or adjusted under 35 U.S.C. 154(b) by 0 days.

(21) Appl. No.: 09/775,888

(22) Filed: Feb. 2, 2001

(65) Prior Publication Data

US 2002/0104954 A1 Aug. 8, 2002

(51) Int. Cl.[7] ..... B28B 7/04

(52) U.S. Cl. ..... 249/97; 249/137; 249/160; 249/170

(58) Field of Search ..... 249/18, 33, 48, 249/97, 137, 139, 160, 161, 170, 8

(56) References Cited

U.S. PATENT DOCUMENTS 769,601 A * 9/1904 Ferguson ..... 249/170
2,267,651 A * 12/1941 Hallisy ..... 249/160
3,642,395 A * 2/1972 Dreher ..... 249/137
4,251,196 A * 2/1981 Toffolon ..... 249/102
5,524,861 A * 6/1996 Solomon ..... 249/152
5,720,467 A * 2/1998 Del Zotto ..... 249/155

* cited by examiner

*Primary Examiner*—James P. Mackey
*Assistant Examiner*—Donald Heckenberg
(74) *Attorney, Agent, or Firm*—Frank L. Kubler

(57) ABSTRACT

A wall and rib form for forming a concrete building wall having a concrete rib protruding perpendicularly from a face of the wall along one wall edge includes a substantially horizontal platform having a platform upper surface defining a perimeter form bottom wall; a form perimeter wall on the platform surface defining a closed loop and having a rib forming segment along which the rib is to be formed which rises above the height of the remainder of the perimeter form side wall to the desired height of the concrete rib, and defines one wall of an overpour trough structure provided along the rib forming linear segment of the perimeter wall.

5 Claims, 3 Drawing Sheets

FIG. 1
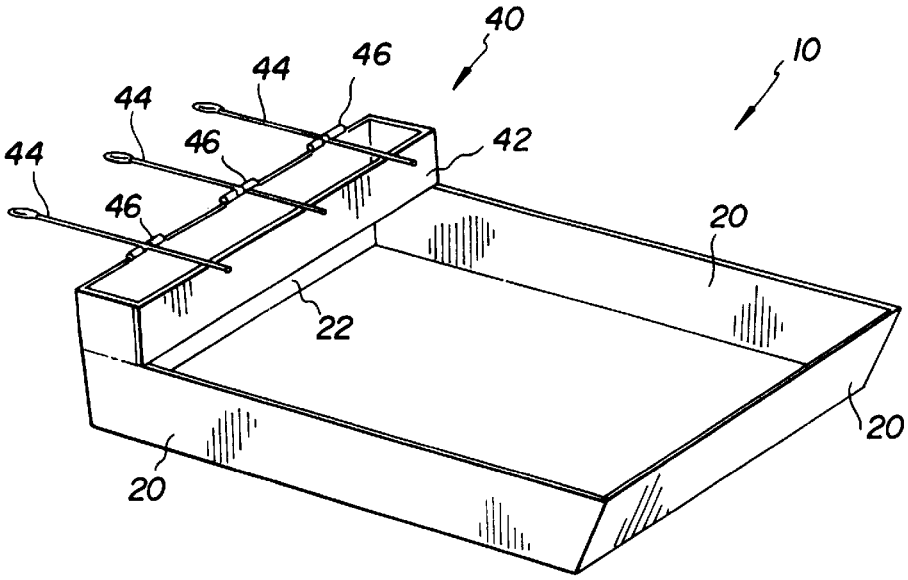
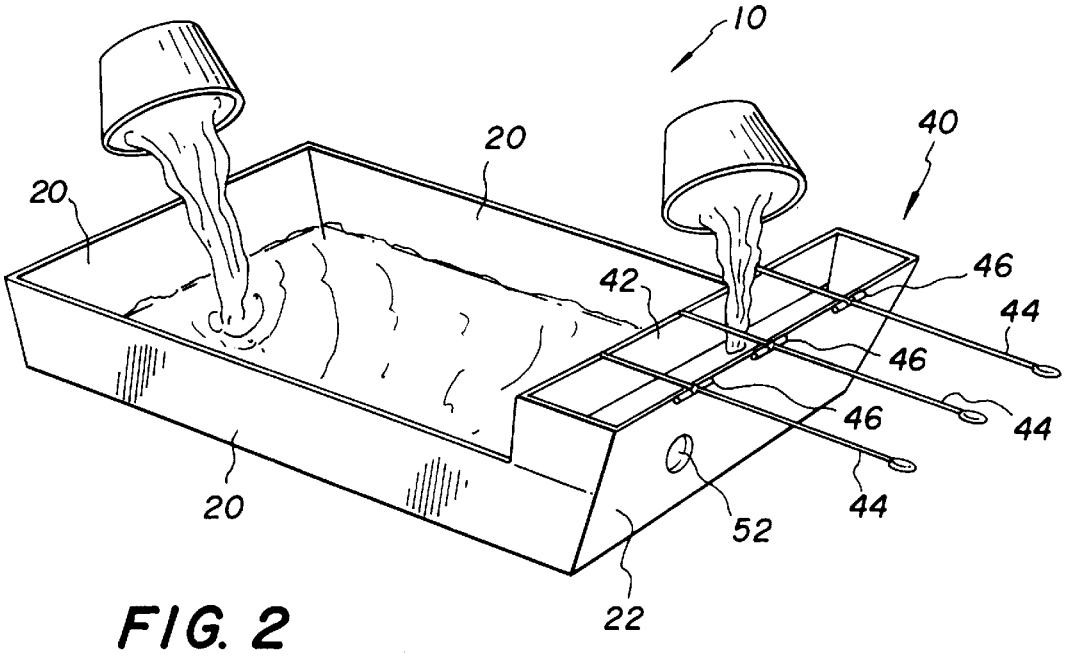
FIG. 2

FIG. 3
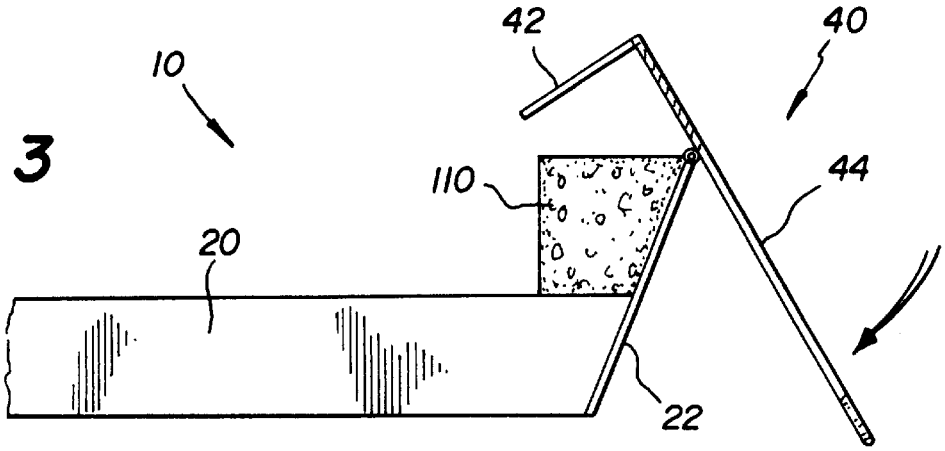
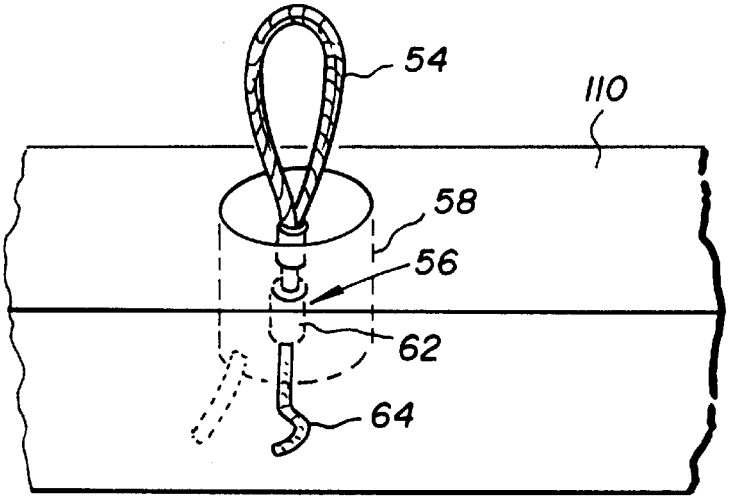
FIG. 4
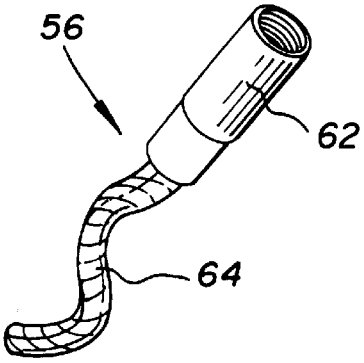
FIG. 5

CONCRETE WALL AND RIB FORM

BACKGROUND OF THE INVENTION

1. Field of the Invention

The present invention relates generally to the field of equipment used in prefabricating building elements for constructing a building, such as in prefabricating concrete building walls and modules. More specifically the present invention relates to a wall and rib form for forming a building wall having a rib protruding perpendicularly from a face of the wall along one wall edge such as to function as an overhang. The wall and rib form includes a form perimeter wall which is placed on a horizontal platform defining a form bottom wall, which is may be a slab but is preferably a tilting table having positioning plates welded to its upper surface between which the perimeter wall is fitted. The perimeter wall is preferably rectangular or square, and includes a rib forming segment along which the rib is to be formed which rises above the height of the rest of the perimeter wall to a height matching the desired concrete rib width, and defines a side wall of a rib forming overpour trough structure. The overpour trough structure includes a pivoting wall extending parallel with and spaced inwardly from the rib forming segment of the perimeter wall such that its longitudinal ends rest on the upper lateral edges of adjacent perimeter wall segments. The upright rib wall has one or more substantially perpendicular lever arms extending from its upper lateral edge across and pivotally mounted to the upper lateral edge of the rib forming segment of the perimeter wall with one or more hinges and extending outwardly from the perimeter wall. The rib forming segment is preferably angled from its upper lateral edge inwardly to its lower lateral end to miter the formed building wall rib. A lifter port is provided in the rib forming segment through which a lifter is fitted prior to the concrete pour to become embedded in the wall.

2. Description of the Prior Art

There have long been forms for pouring concrete walls, some of which have included protruding concrete ribs. A problem with these prior wall forms has been that the rib portion of the cured wall has been difficult to remove from the form.

It is thus an object of the present invention to provide a concrete wall and rib form which includes means for easy disengagement of a concrete rib formed as part of the wall.

It is another object of the present invention to provide such a form which is easy to use.

It is still another object of the present invention to provide such a form which is simple in construction, and made from common and inexpensive materials.

It is finally an object of the present invention to provide such a form which is sturdy and reliable.

SUMMARY OF THE INVENTION

The present invention accomplishes the above-stated objectives, as well as others, as may be determined by a fair reading and interpretation of the entire specification.

A wall and rib form is provided for forming a concrete building wall having a concrete rib protruding perpendicularly from a face of the wall along one wall edge, the form including a substantially horizontal platform having a platform upper surface defining a perimeter form bottom wall; a form perimeter wall on the platform surface defining a closed loop and having a rib forming segment along which the rib is to be formed which rises above the height of the remainder of the perimeter form side wall to the desired height of the concrete rib, and defines one wall of an overpour trough structure provided along the rib forming linear segment of the perimeter wall.

The horizontal platform is preferably a tilting table, and the form perimeter wall is preferably one of: rectangular and square. The overpour trough structure preferably includes a pivoting wall extending substantially parallel with and spaced inwardly from the rib forming segment of the perimeter wall so that the longitudinal ends of the pivoting wall rest on the upper lateral ends of adjacent segments of the perimeter wall, and includes at least one lever arm extending substantially perpendicularly from the pivoting wall across and pivotally mounted to the rib forming segment with hinges and extending outwardly from the perimeter wall.

The rib forming segment is angled from its upper lateral end inwardly to its lower lateral end to miter the concrete rib. The wall and rib form preferably additionally includes a lifter port in the rib forming segment and a lifter fitted into the lifter port prior to pouring of concrete into the form.

BRIEF DESCRIPTION OF THE DRAWINGS

Various other objects, advantages, and features of the invention will become apparent to those skilled in the art from the following discussion taken in conjunction with the following drawings, in which:

FIG. 1 is a perspective view of the preferred wall and rib form.

FIG. 2 is another perspective view of the wall and rib form showing uncured concrete being poured into the form and trough structure.

FIG. 3 is a side view of the pivoting wall being pivoted away from a formed rib.

FIG. 4 shows a lifter removably screwed into threaded tube affixed around an end of a reinforcing bar embedded in a building wall upper end, with the PVC tube segment encircling the lifter to provide open space within the wall upper end to receive the lifter. A crane lifting hook is shown above the lifter.

FIG. 5 is a perspective view of the reinforcing bar and press fitted threaded tube for embedding into a wall rib.

DETAILED DESCRIPTION OF THE PREFERRED EMBODIMENTS

Figure 6:
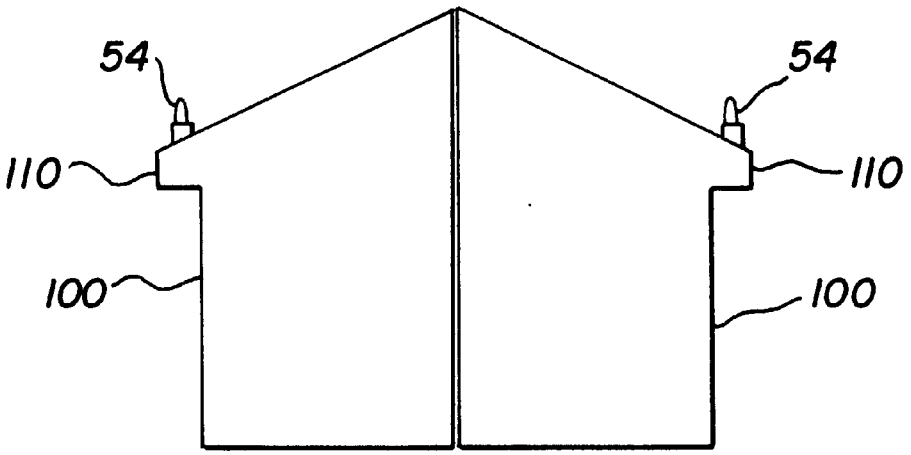
FIG. 6 is a side view of a pair of adjoining building modules showing overhang ribs formed by the disclosed wall and rib form.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 7:
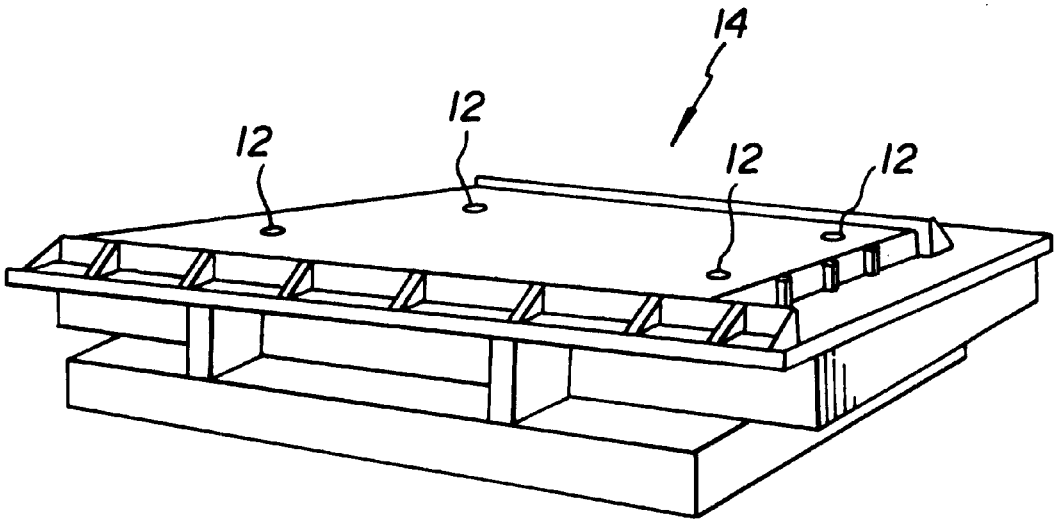
FIG. 7 is a perspective view of a tilting table showing the form positioning plates welded onto the tilting table upper surface.

Referring to FIGS. 1–6, a wall and rib form 10 is disclosed for forming a building wall 100 having a rib 110 protruding perpendicularly from a face of the building wall 100 along one wall 100 edge such as to function as an overhang. The wall and rib form 10 includes a perimeter wall 20 which is placed on a horizontal platform which may be a slab but is preferably a tilting table 14 and preferably has positioning plates 12 welded onto its upper surface between which the perimeter wall 20 is fitted. See FIG. 7. The perimeter wall 20 is preferably rectangular or square, and includes a rib forming segment 22 along which the rib 110 is to be formed which rises above the rest of perimeter wall 20 to a height matching the desired concrete rib 110 width, and defines a side wall of an overpour rib form 40. The overpour rib form 40 includes a pivoting wall 42 extending parallel with and spaced inwardly from the rib forming segment 22 of the perimeter wall 20 such that the pivoting wall 42 longitudinal ends rest on the upper lateral edges of adjacent perimeter wall 20 segments. The upright pivoting wall 42 has one or more substantially perpendicular lever arms 44 extending from its upper lateral edge across and pivotally mounted to the upper lateral edge of the rib forming segment 22 of the perimeter wall with one or more hinges 46 and extending outwardly from the perimeter wall 20. The rib forming segment 22 is preferably angled from its upper lateral edge inwardly to its lower lateral end to miter the formed building wall rib 110. A lifter port 52 is provided in the rib forming segment 22 through which a lifter 54 mounting structure 56 and polyvinyl chloride (PVC) tube segment 58 are fitted prior to the concrete pour to become embedded in the wall 100. A lifter 54 may be removably screwed into the mounting structure 56, which includes a threaded tube 62 press-fitted around an end of a reinforcing bar 64 embedded in a building wall upper end. The PVC tube segment 58 encircling the lifter 54 to provide open space within the wall 100 upper end to receive the lifter 54. See FIG. 5.

The building walls may contain insulating foam metal and plastic stud channels for dry wall fasteners, as disclosed in the following prior U.S. Patents to applicant:

U.S. Pat. No. 5,313,753, issued on May 24, 1994 and

U.S. Pat. No. 5,381,635, issued on Jan. 17, 1995.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A wall and rib form for forming a concrete building wall having a concrete rib protruding perpendicularly from a face of the wall along one wall edge, comprising:

a substantially horizontal platform having a platform upper surface defining a form bottom wall;

a form perimeter wall extending upwardly from said platform upper surface defining a closed loop and having a rib forming perimeter wall segment which rises above the height of the remainder of said form perimeter wall to the desired height of the concrete rib along which the rib is to be formed, and defines one wall of an overpour trough structure provided along the rib forming perimeter wall segment;

an overpour trough structure comprising said rib forming perimeter wall segment extending above the remainder of said form perimeter wall and a trough wall extending substantially parallel with and spaced inwardly from said rib forming segment of said perimeter wall a distance corresponding to the desired width of the concrete rib for forming the concrete rib;

and a lifter port in said rib forming segment and a lifter fitted into said lifter port prior to pouring of concrete into said form.

2. The wall and rib form of claim 1, wherein said horizontal platform is a tilting table.

3. The wall and rib form of claim 1, wherein said form perimeter wall is one of: rectangular and square.

4. A wall and rib form for forming a concrete building wall having a concrete rib protruding perpendicularly from a face of the wall along one wall edge, comprising:

a substantially horizontal platform having a platform upper surface defining a perimeter form bottom wall;

a form perimeter wall on said platform surface defining a closed loop and having a rib forming segment along which the rib is to be formed which rises above the height of the remainder of said perimeter form side wall to the desired height of the concrete rib, and defines one wall of an overpour trough structure provided along the rib forming segment of the perimeter wall, said overpour trough structure comprising a pivoting wall extending substantially parallel with and spaced inwardly from said rib forming segment of said perimeter wall, wherein said pivoting wall is pivotally mounted to the remainder of the wall and rib form with hinge means to pivot relative to said perimeter wall.

5. The wall and rib form of claim 4, wherein said rib forming segment is angled from its upper lateral end inwardly to its lower lateral end to miter the concrete rib.

* * * * *